US005969607A

United States Patent [19]

Cox

[11] Patent Number: 5,969,607

[45] Date of Patent: Oct. 19, 1999

[54] PORTABLE DOOR LOCK AND ALARM

[76] Inventor: Kelly Cox, deceased, #26 Gladys Ridge Rd. S.W., late of Calgary, Alberta T3E 4H8, Canada, by Willa Cox, executor

[21] Appl. No.: 09/178,784

[22] Filed: Oct. 26, 1998

[51] Int. Cl.[6] ..... G08B 13/08

[52] U.S. Cl. ..... 340/546; 340/545.1; 292/258

[58] Field of Search ..... 340/541, 545.1, 340/545.2, 546, 549; 292/258, 259 R, 288, DIG. 17

[56] References Cited

U.S. PATENT DOCUMENTS

| | | | |
|---|---|---|---|
| 4,351,552 | 9/1982 | VanDerLinden | 292/201 |
| 4,439,758 | 3/1984 | Cantley | 340/546 |
| 4,442,427 | 4/1984 | Morton | 340/546 |
| 4,808,974 | 2/1989 | Cantley | 340/546 |
| 5,265,922 | 11/1993 | Falcone | 292/258 |
| 5,340,175 | 8/1994 | Wood | 292/339 |
| 5,341,123 | 8/1994 | Schuman, Sr. et al. | 340/546 |

*Primary Examiner*—Jeffery A. Hofsass
*Assistant Examiner*—Van T. Trieu
*Attorney, Agent, or Firm*—David S. Thompson

[57] ABSTRACT

A portable door lock and alarm is adapted to connected to the hinge carried between a door and a doorjamb. The portable door lock and alarm provides an enclosure housing a lock mechanism which includes a claw defining small and large hinge passages adapted to surround small or large door hinges. A bolt, extending from the claw and through the enclosure, is threaded onto a knob. After attachment of the claw to the hinge, rotation of the knob retracts the claw into the enclosure, increasing the pressure between the door and doorjamb and the enclosure. An attempt to open the door will increase the pressure on the enclosure; however, in a typical application, the door will crack, break or deform before the enclosure of the lock is crumpled. A circuit provides a switch that is closed if an attempt is made to open the door, thereby resulting in activation of an annunciator.

3 Claims, 4 Drawing Sheets

10
20
24
40
42
43
44
45
46
47
48
49
60
62
63
65
66
68
69
70
71
81
82
83
84
100
101
102
102
103
103

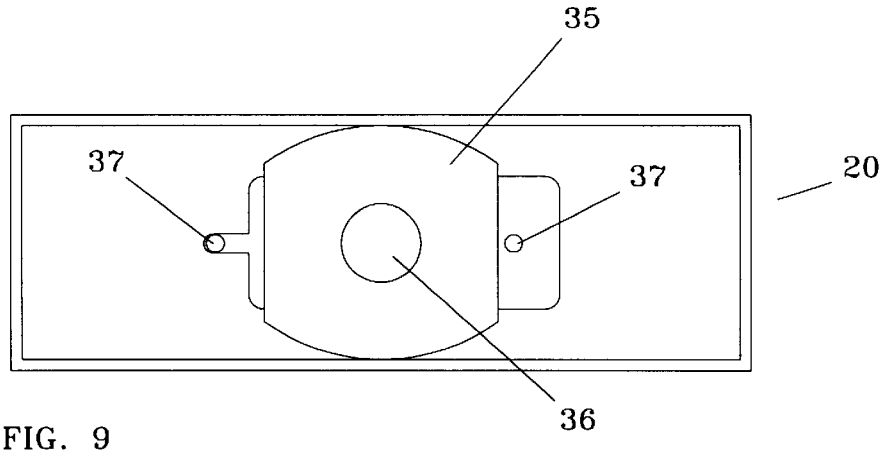
FIG. 9
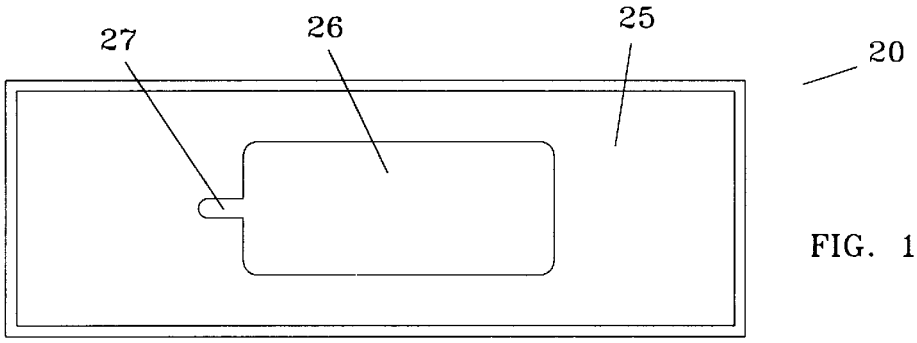
FIG. 10
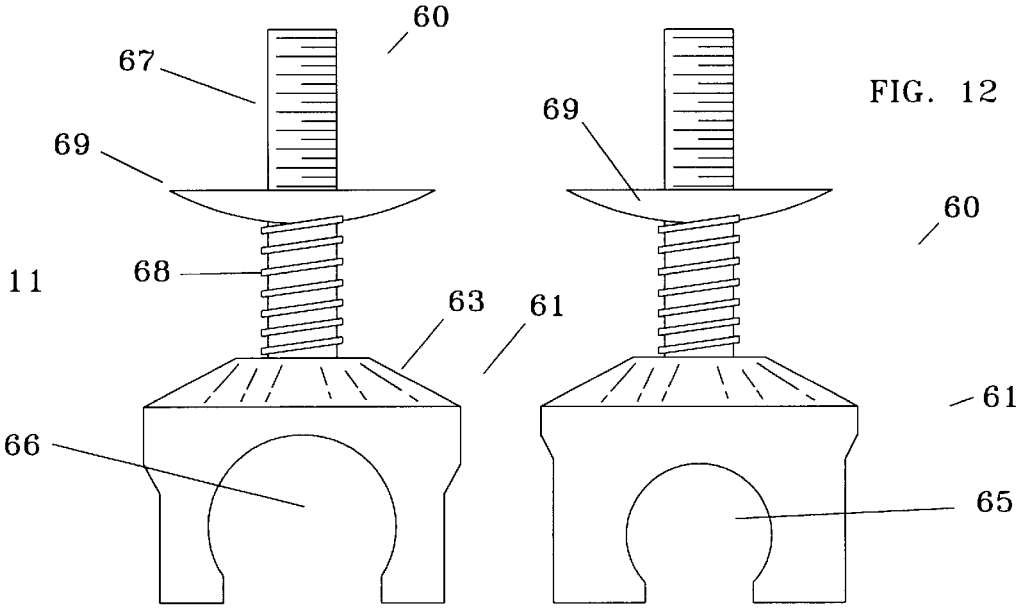
FIG. 11
FIG. 12

PORTABLE DOOR LOCK AND ALARM

CROSS-REFERENCES

There are no applications related to this application filed in this or any foreign country.

BACKGROUND

A wide range of mechanical, electronic and hybrid door locks and alarms are known. Most focus on the need to maintain a locked connection between the portion of the door adjacent to the doorknob and door frame.

Unfortunately, there is rarely a structure available, adjacent to the doorknob, that allows the temporary attachment of a locking device. As a result, most locks require permanent modification to the door and/or door frame.

Due to the need to modify the door and frame, few locks are portable; as a result they cannot be easily installed or removed from any door. Due to this flaw, few locks are adapted to meet the needs of travelers, who may want to provide additional locking security to hotel rooms and other locations, but who may want to remove the lock at any time for transfer to another location.

Similarly, few locks have any type of built-in electronics which result in an alarm being activated by any type of tampering or attempted entry.

What is needed is a portable door lock and alarm combination, which is easily installed and removed from any door without damage or alteration. The portable door lock and alarm should be compact, inexpensive and easily transported, installed and removed. The door lock must install on structures common to all doors, and should not require any modification to the door or doorjamb.

SUMMARY

The present invention is directed to an apparatus that satisfies the above needs. A novel portable door lock and alarm is provided that is easily transported, installed and removed, all without damaging or requiring modification of the door to be locked or associated doorjamb.

The portable door lock and alarm of the present invention provides some or all of the following structures.

(A) A preferred enclosure is typically six-sided, having a top surface, a bottom surface, elongated side surfaces and opposed end surfaces. A top plate defines a round center hole in a central location in the top side. The bottom surface defines a mechanism opening, and the side surfaces define opposed door hinge notches.

(B) A mechanism, carried within the enclosure, provides a lower claw and a bolt extending upwardly from the claw, passing through the round center hole of the top plate carried by the top side of the enclosure. The lower claw defines orthogonally oriented small and large passages, which are sized to enclose small and large door hinges, and are carried adjacent to the door hinge notches of the side surfaces.

(C) A knob is threaded to the bolt of the mechanism, and is carried against the top plate of the enclosure. Tightening the knob on the bolt pulls the claw of the mechanism and the door's hinge, carried by the claw, into the enclosure. Tightening the knob also presses the bottom surface of the enclosure against the door and doorjamb, thereby preventing the door from being opened.

(D) An electronic circuit, carried within the knob, provides a battery, horn, LED and switch, whereby motion resulting from movement of the door results in the switch being closed and the horn and LED being activated.

It is therefore a primary advantage of the present invention to provide a novel portable door lock and alarm which grasps and holds the hinge portion of the door, and which provides an enclosure which applies pressure to the door and doorjamb if an attempt is made to open the door, thereby preventing the door from opening.

Another advantage of the present invention is to provide a novel portable door lock and alarm which provides both audible and visual indicators when an attempt is made to open the door.

A still further advantage of the present invention is to provide a novel portable door lock and alarm which does not require modification of the door or doorjamb, and which is easily and rapidly installed and removed.

DRAWINGS

These and other features, aspects, and advantages of the present invention will become better understood with regard to the following description, appended claims, and accompanying drawings where:

FIG. 9 is a cross-sectional view, taken along the 9—9 lines of FIG. 2, of the enclosure, showing the inside of the top surface and the top plate.

FIG. 10 is a cross-sectional view, taken along the same lines as that of FIG. 9, of the enclosure, but having the top plate removed, to better illustrate the center opening in the top surface.

FIG. 11 is a side orthographic view of the mechanism, showing the large passage through the claw, which is adapted to grasp larger door hinges.

FIG. 12 is a side orthographic view of the mechanism, showing the small passage through the claw, which is adapted to grasp smaller door hinges.

DESCRIPTION

Figure 1:
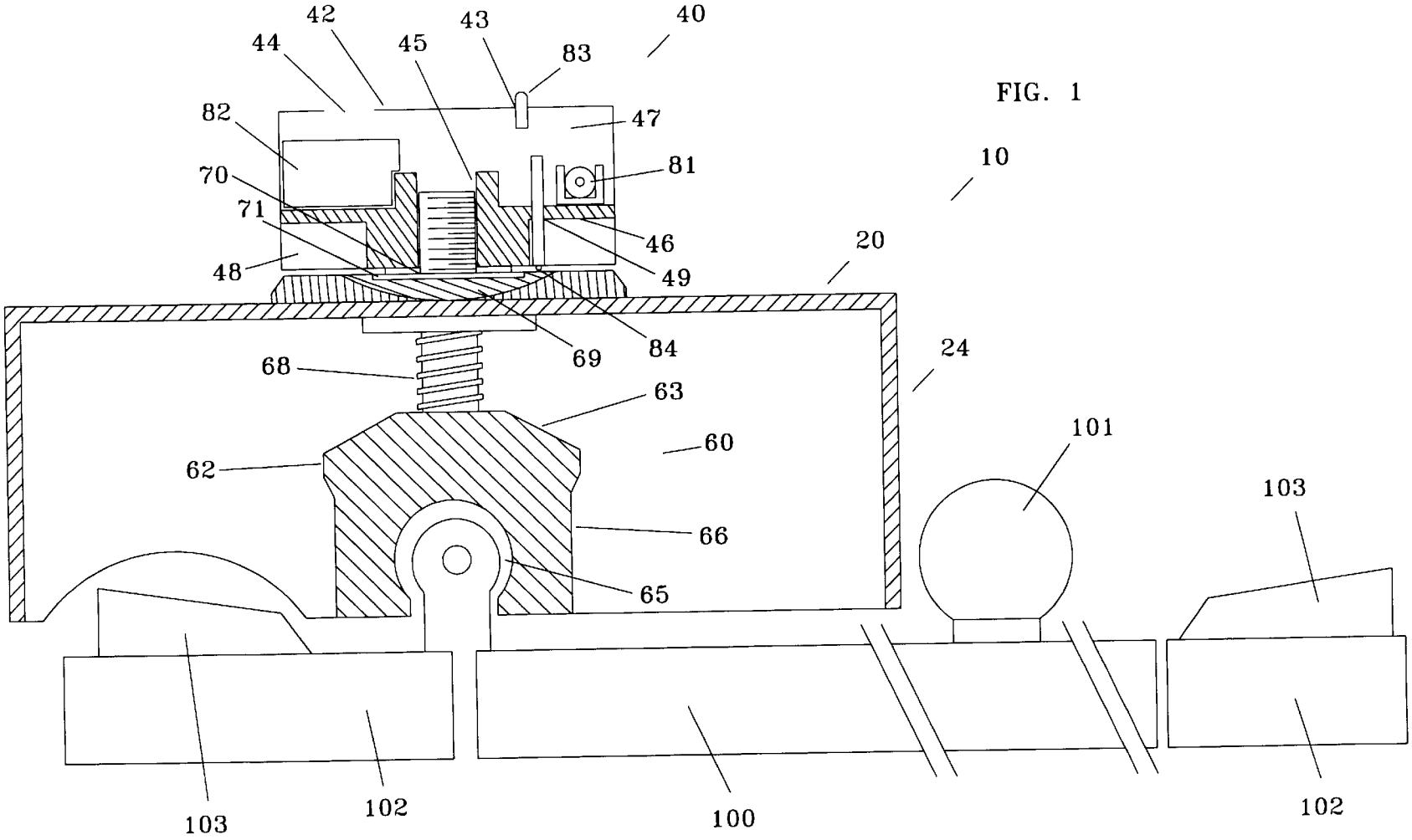
FIG. 1 is a somewhat diagrammatic cross-sectional view of a version of the portable door lock and alarm of the invention, wherein a door hinge is engaged by the mechanism portion of the door lock, and showing the associated door, doorjamb and door knob.

Referring in generally to FIGS. 1 through 11, a portable door lock and alarm 10 constructed in accordance with the principles of the invention is seen. The door lock and alarm is adapted to connected to the hinge 104 carried between a door 100 and a doorjamb 102, on the side of the door opposite the doorknob 101. The portable door lock and alarm provides an enclosure 20 housing a lock mechanism 60 which includes a claw defining small and large hinge passages adapted to surround small or large door hinges. A bolt, extending from the claw and through the enclosure, is threaded onto a knob 40. After attachment of the claw to the hinge, rotation of the knob retracts the claw into the enclosure, increasing the pressure between the door and doorjamb and the enclosure. An attempt to open the door will increase the pressure on the enclosure; however, in a typical application, the door will crack, break or deform before the enclosure of the lock is crumpled. A circuit 80 provides a switch that is closed if an attempt is made to open the door, thereby resulting in activation of an annunciator.

An enclosure 20 houses the mechanism 60 and provides a rigid structure which, when attached to the hinge of a door, prevents the door from being opened. A preferred embodiment of the enclosure is six-sided, and provides opposed side surfaces 21 and opposed end surfaces 24, a top surface 25 and a bottom surface 28. The enclosure may be made of aluminum, steel or other rigid material.

Referring to FIGS. 1, 8, 9 and 10, the top surface 25 defines a center opening 26 over which a top plate 31 is carried, and a bolt notch 27, within which a bolt 37 holding the top plate in place is able to slide.

Figure 3:
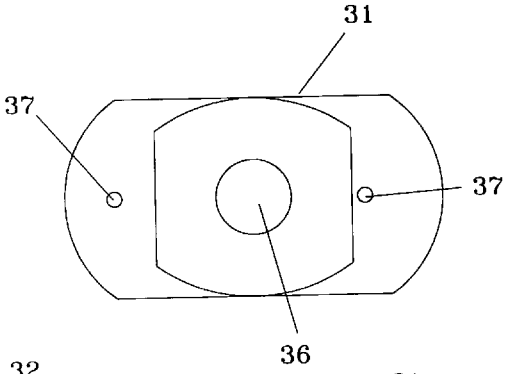
FIG. 3 is a top orthographic view of the top plate, carried by the top surface of the enclosure.
Figure 4:
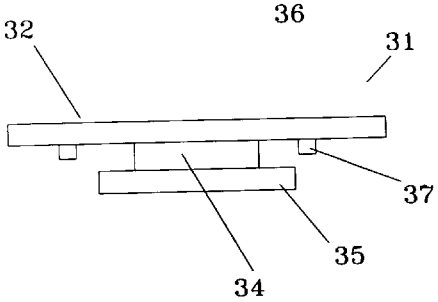
FIG. 4 is a side orthographic view of the top plate of FIG. 3, showing the spacer plate and inside plate.

Referring to FIGS. 3 and 4, the structure of the top plate 31 can be seen. The top plate provides a surface to support the knob 40, allowing the knob to be more easily and precisely controlled. An upper surface 32 of the top plate defines a generally cone shaped depression 33 defining a center hole 36. As seen in FIG. 1, the center hole allows the bolt 67 of the mechanism to pass. Referring particularly to FIG. 4, the top plate 31 carries a spacer plate 34 having a thickness equal to, or incrementally greater than, the thickness of the top surface 25 of the enclosure. The spacer plate in turn carries the inside plate 35, seen in FIGS. 1 and 4. The inside plate 35 and top plate 31, separated by the spacer plate 34, are supported by the top surface 25 which is between them, and have a limited range over which they can slide on the top surface of the enclosure.

Referring to FIG. 9, two bolts 37 which are carried by the top plate 31 limit the range over which the top place can slide and prevent rotation of the top plate. One bolt slides in the bolt notch 27. During installation of the top plate, the bolts 37 are removed, the top plate is rotated at 90 degrees and placed into the center opening 26. It is then rotated 90 degrees and bolted into place.

Figure 2:
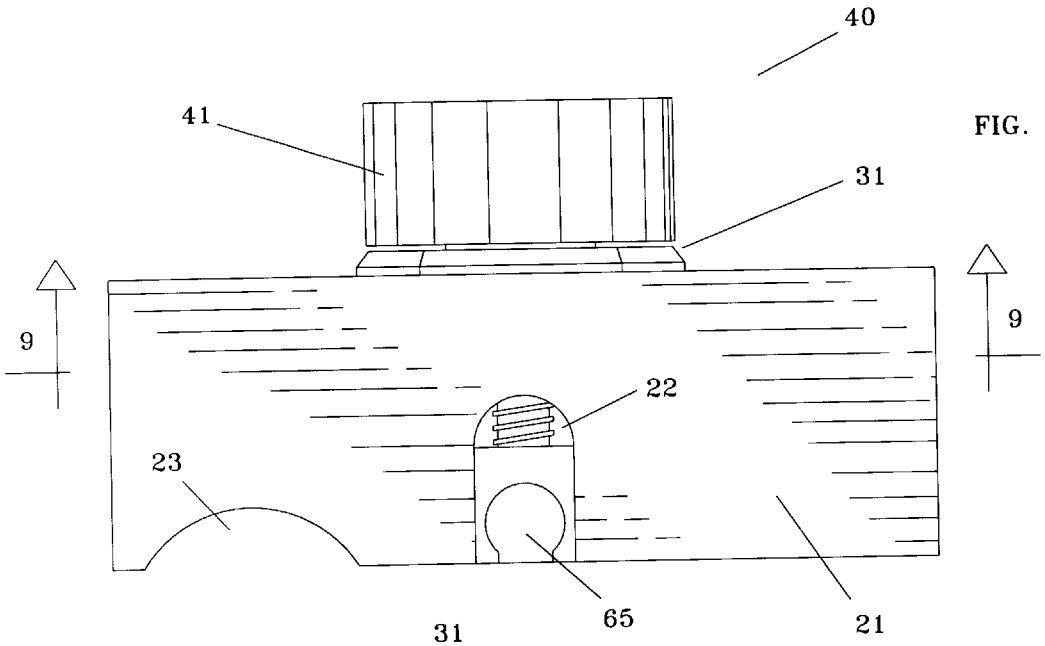
FIG. 2 is a side orthographic view of the portable door lock and alarm of FIG. 1, showing an elongated side surface defining a door hinge notch and a portion of the claw of the mechanism carried within the enclosure.

Referring to FIG. 2, the structure of the side surface 21 is best seen. Each of the two opposed side surfaces define a door hinge notch 22 and a molding notch 23. The door hinge notch 22 is sized to be large enough to slide over the end of any typical hinge used to hang any typical door. The molding notch 23 is sized to fit over a molding 103 carried by a doorjamb 102.

Figure 6:
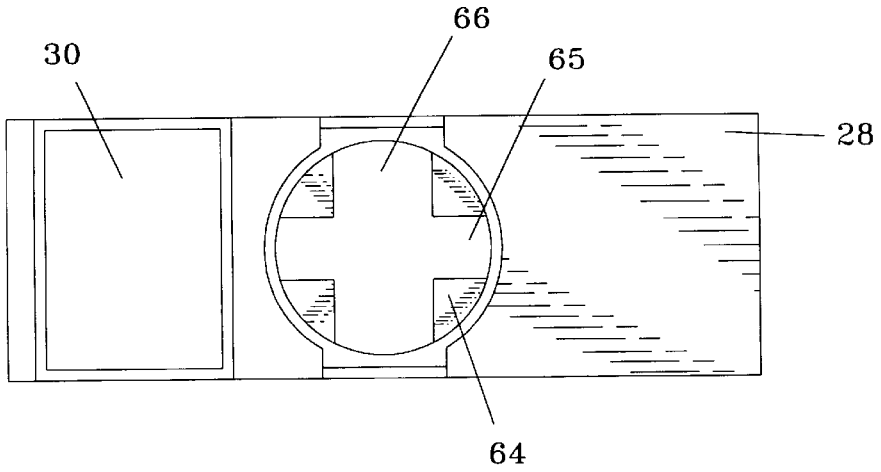
FIG. 6 is an orthographic view of the bottom surface of the lock of FIG. 1, showing the mechanism and molding openings defined in the bottom surface of the enclosure, and a portion of the mechanism carried within the enclosure.
Figure 7:
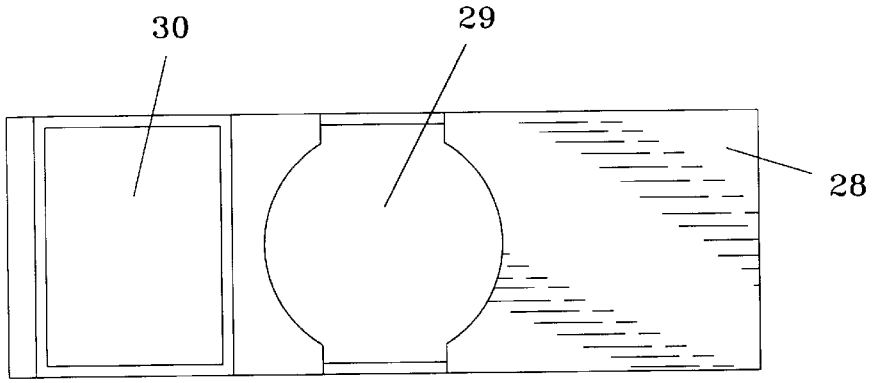
FIG. 7 is an orthographic view of the bottom surface of the enclosure, with the mechanism removed to better show the enclosure.
Figure 8:
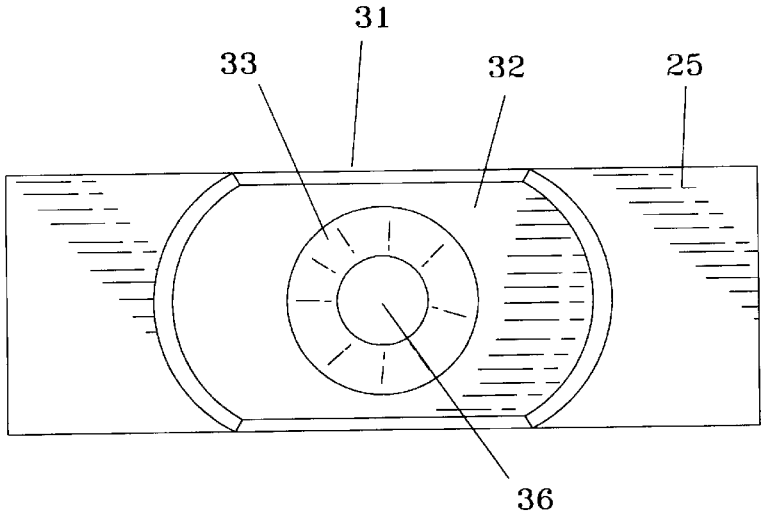
FIG. 8 is an orthographic view of the top surface of the enclosure, showing the top plate carried by the top surface of the enclosure.

Referring to FIGS. 6 and 7, the structure of the bottom surface 28 is seen. The bottom surface defines a mechanism opening 29 and a molding opening 30. The mechanism opening 29 is generally rounded, and is adjacent to the lower end of the mechanism 60. The molding opening 30 is defined between the molding notches 23 in the opposed side surfaces.

Referring to FIGS. 1, 6, 11 and 12, the structure of the mechanism 60 can be seen. The mechanism provides a claw 61 having an attached bolt 67 which allows the claw to be retracted into the enclosure after it has been attached to a hinge, as seen in FIG. 1. In a preferred embodiment, the mechanism is made of steel.

Referring particularly to FIGS. 1, 11 and 12, the cylindrical side 62 and sloping top 63 of the claw is seen. The cylindrical portion of the claw defines orthogonally oriented small and large hinge passages 65, 66. The small and large hinge passages are sized to enclose small and large hinges found on doors of differing weight and quality.

The orthogonal nature of the passages 65, 66 is best seen in FIG. 6, where the feet 64 carried by the bottom of the claw are seen.

As seen in FIG. 1, a bolt 67 extends from an upper portion of the claw. A spring 68 is carried by the bolt, which biases the claw away from the top surface 25 of the enclosure. After assembly, the bolt passes through the top surface 25 and the center hole 70 of a rounded stopper 69 and washer 71. An upper portion of the bolt is threaded into the knob, as seen in FIG. 1.

As seen in FIGS. 1 and 2, a threaded bolt hole 45 within the knob 40 is threaded onto the upper end of the bolt 67. The knob is then seated against the top plate 31 and rounded stopper 69. Once seated, rotation of the knob extends or retracts the mechanism 60, as can be seen by examination of FIG. 1.

A preferred version of the knob 40 includes a cylindrical side 41 having a center plate 46 dividing the cylinder into an upper cavity 47 and a lower cavity 48. A preferred face plate 42 defines LED openings 43 and sound openings 44. The LED openings allow the mounting of one or more LED lights, while the sound openings form a grill that allows sound generated by the horn to escape. A switch passage 49, extending through the center plate 46, allows a pressure sensitive single pole, single throw switch 84 to be installed.

Figure 5:
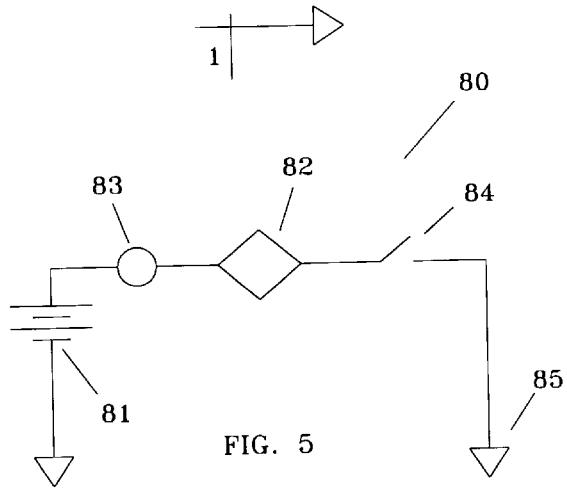
FIG. 5 is a diagrammatic view of the electrical circuit carried within the knob portion of the portable door lock and alarm of FIG. 1.

As seen in the circuit diagram of FIG. 5, the portable door lock and alarm 10 has an alarm circuit 80 which causes an annunciator to activate if the door is moved after installation of the lock and alarm 10. The battery 81 is attached in series or parallel to one or more annunciators, such as a horn or buzzer 82, a light 83 or light emitting diode (LED). A preferred version of the circuit has a ground 85 attached to the center plate 46 of the knob 40. A switch 84 is carried by the switch passage 49, through the center plate 46. When the knob is tightened, the switch makes contact with the rounded stopper 69 of the mechanism 60, causing the alarm to go off. When the knob 40 is turned counterclockwise slightly, the switch is moved outwardly and out of contact with the stopper, and the annunciator is turned off. In this position any movement tending to open the door Will tend to push the enclosure away from the door, thereby tightening the connection between the mechanism and the enclosure. This will result in the annunciator turning on.

To use the portable door lock and alarm 10, the door to be locked is first closed. The size of the door's hinge 104 is evaluated, and the mechanism 60 is spun within the enclosure until the small or large hinge passage 65, 66, as desired, is facing the hinge notches 22 in the side surface 21 of the enclosure 20. The hinge passage is then slipped over the hinge, as seen in FIG. 1. The knob 40 is then tightened, thereby drawing the claw 61 into the enclosure. The alarm will sound when the mechanism is tight. The knob is then reversed slightly, until the mechanism loosens sufficiently to break the electrical connection and turn off the alarm. If an attempt is made to open the door, the enclosure will block the movement of the door, thereby making opening impossible. The pressure against the enclosure caused by the door being opened even slightly will cause the annunciators to activate.

The previously described versions of the present invention have many advantages, including a primary advantage of providing a novel portable door lock and alarm which grasps and holds the hinge portion of the door, and which provides an enclosure which applies pressure to the door and doorjamb if an attempt is made to open the door, thereby preventing the door from opening.

Another advantage of the present invention is to provide a novel portable door lock and alarm which provides both audible and visual indicators when an attempt is made to open the door.

A still further advantage of the present invention is to provide a novel portable door lock and alarm which does not require modification of the door or doorjamb, and which is easily and rapidly installed and removed.

Although the present invention has been described in considerable detail and with reference to certain preferred versions, other versions are possible. For example, while the shape of a preferred enclosure has been disclosed, other equivalent shapes could be used, supporting a similar locking mechanism 60 and having similar functionality. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A portable door lock and alarm, for grasping a hinge of a door and for pressing against the door and doorjamb, the portable door lock and alarm comprising:

(A) an enclosure, having a bottom surface defining a mechanism opening, and having opposed side surfaces defining door hinge notches;

(B) a mechanism, carried within the enclosure, having a lower claw and a bolt extending from the claw, the lower claw defining at least one hinge passage, wherein the claw is carried adjacent to the door hinge notches of the side surfaces; and (C) a knob, threadedly carried by the bolt of the mechanism, whereby tightening the knob on the bolt pulls the claw of the mechanism and the door's hinge, carried by the claw, into the enclosure and presses the bottom surface of the enclosure against the door and doorjamb, thereby preventing the door from being opened.

2. The portable door lock and alarm of claim 1, further comprising:

(A) an electronic circuit, carried within the knob, having a battery, connected to an annunciator and a switch, whereby motion resulting from movement of the door results in the switch being closed and the annunciator being activated.

3. A portable door lock and alarm, for grasping a hinge of a door and for pressing against the door and doorjamb, the portable door lock and alarm comprising:

(A) a six-sided enclosure, having a top surface, a bottom surface, elongated side surfaces and opposed end surfaces, wherein the top surface carries a top plate defining a round center hole, and wherein the bottom surface defines a mechanism opening, and wherein the side surfaces define opposed door hinge notches;

(B) a mechanism, carried within the enclosure, having a lower claw and a bolt extending upwardly from the claw, the bolt passing through the round center hole of the top plate carried by a top side of the enclosure, the lower claw defining orthogonally oriented small and large hinge passages, wherein the claw is carried adjacent to the door hinge notches of the side surfaces;

(C) a knob, threadedly carried by the bolt of the mechanism against the top plate of the enclosure, whereby tightening the knob on the bolt pulls the claw of the mechanism and the door's hinge, carried by the claw, into the enclosure and presses the bottom surface of the enclosure against the door and doorjamb, thereby preventing the door from being opened; and (D) an electronic circuit, carried within the knob, having a battery, connected to an annunciator and a switch, whereby motion resulting from movement of the door results in the switch being closed and the annunciator being activated.

* * * * *